United States Patent [19]

Young, Jr.

[11] 3,967,346

[45] July 6, 1976

[54] DISPLAY RACK CLIP

[76] Inventor: Bruce Young, Jr., 105 Masters Road, Hixson, Tenn. 37343

[22] Filed: Sept. 5, 1974

[21] Appl. No.: 503,489

[52] U.S. Cl. ..... 24/73 B; 24/81 B; 211/89; 211/190; 248/316 D

[51] Int. Cl.[2] ..... A47F 5/10

[58] Field of Search ..... 24/81 B, 81 PC, 11 F, 24/73 B, 259 FF; 211/45, 89, 176; 248/316 D, 451

[56] References Cited

UNITED STATES PATENTS

| | | | |
|---|---|---|---|
| 1,196,087 | 8/1916 | Crume | 211/89 X |
| 1,925,202 | 9/1933 | Provost | 211/89 |
| 2,154,046 | 4/1939 | Kost | 248/316 D |
| 2,278,691 | 4/1942 | Cotter | 248/316 D |
| 2,532,021 | 11/1950 | Gunderson | 211/89 |
| 2,562,777 | 7/1951 | Dreyfus, Jr. | 211/89 |
| 2,937,758 | 5/1960 | Tabb | 211/89 X |
| 3,054,511 | 9/1962 | Erisman | 211/176 |
| 3,235,209 | 2/1966 | Seckersen et al. | 24/81 B |

*Primary Examiner*—Werner H. Schroeder
*Attorney, Agent, or Firm*—Shoemaker and Mattare

[57] ABSTRACT

A display rack clip for supporting articles, such as bags of chips and the like, for display and sale to the public, includes a substantially S-shaped spring clip, one end portion of which is adapted to be inserted through an opening in a support member with an adjacent curved portion thereof resiliently engaged against the support member to releasably grip the article between the clip and the support member, said clip being adapted for machine assembly to the support member.

14 Claims, 6 Drawing Figures

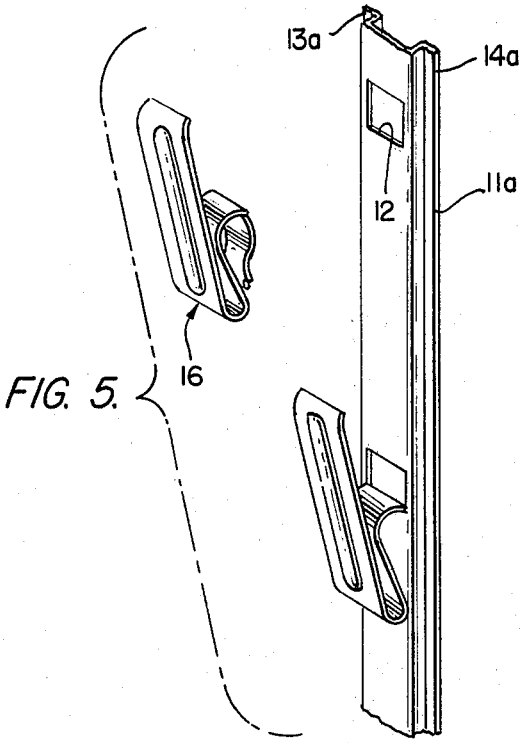
FIG. 5.
FIG. 6.
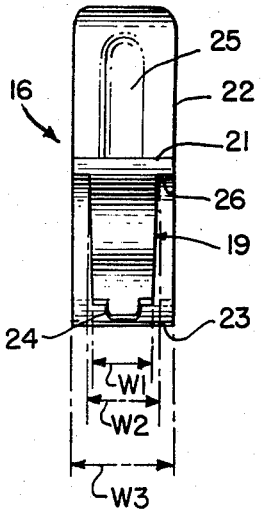

DISPLAY RACK CLIP

BACKGROUND OF THE INVENTION

This invention relates to display rack clips of the type which are used to hold articles on a display rack for display and sale to the general public, such as, for example, bags of potato chips and the like.

Prior art clips of this type are either expensive to manufacture or are relatively complicated and expensive to assemble or do not work very effectively or require hand assembly.

The present invention provides a display rack clip which is economical to manufacture and sell and which is effective in use and which may be assembled either by hand or by machine, thus enabling large numbers of the clips to be applied to a support member simultaneously, thus decreasing the cost of the display rack clip to a purchaser thereof.

More particularly, the present invention comprises a substantially S-shaped spring steel clip, one end portion of which is adapted to be inserted through an opening in a support member, such as a support channel or the like, with an adjacent curved portion of the clip resiliently engaged against a support member, and said one end portion resiliently engaged against the underside of the support member to securely latch the clip to the support member. An article, such as the edge of a bag of potato chips or the like, may then be inserted between the curved portion and the support member and releasably gripped thereat for supporting the bag of chips and the like on a display rack. Moreover, the other end portion of the clip is elongate and comprises a handle or lever, which may be urged toward the support member and against the other curved portion of the clip to move the one curved portion away from the support member to release the article, if desired.

OBJECTS OF THE INVENTION

It is an object of this invention to provide a display rack clip for supporting and displaying articles for sale to the public, wherein the clip is economically manufactured and assembled to a support member and comprises a substantially S-shaped member, one end portion of which is inserted through an opening in the support member and a curved portion adjacent thereto engages the support member for gripping an article between the curved portion and support member.

A further object of the invention is to provide a display rack clip which is adapted for machine assembly to a support channel or member and which has stop means thereon for automatically stopping the insertion of an end portion through an opening in the support member at a predetermined desired location, with a curved portion of the clip engaged against a support member for gripping an article therebetween.

BRIEF DESCRIPTION OF THE DRAWINGS

FIG. 5 is a view similar to FIG. 2 of the clip and a modified support or channel member.

FIG. 6 is a rear view in elevation of the clip according to the invention.

DETAILED DESCRIPTION OF THE INVENTION

Figure 1:
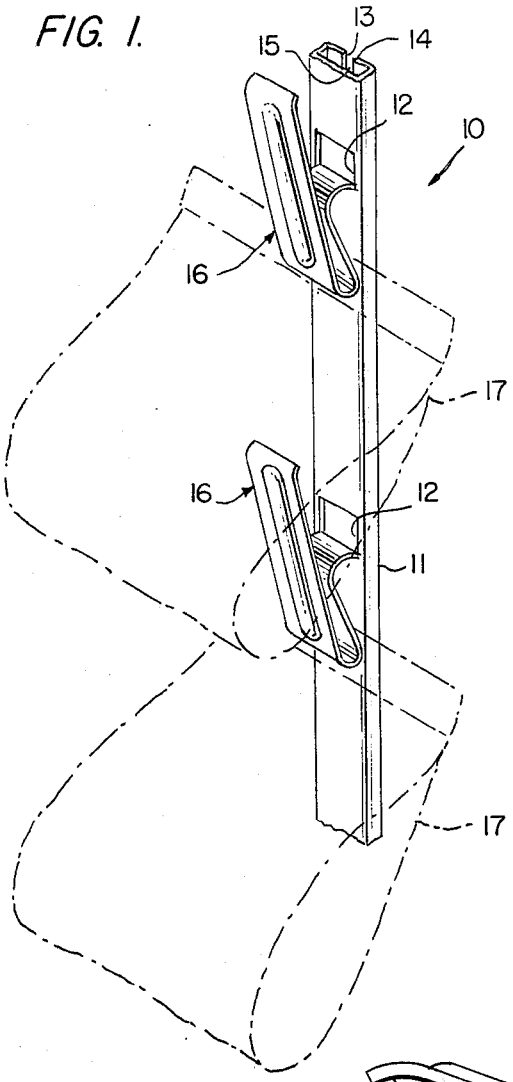
FIG. 1 is a fragmentary perspective view of a support member and a pair of clips in accordance with the invention, with a pair of articles shown in phantom lines gripped by the clips.

In the drawings, wherein like parts are indicated by like reference numerals throughout the several views, a portion of a display rack is indicated generally at 10 in FIG. 1 and comprises a generally channel-shaped upright support member 11 having a plurality of punched out or otherwise suitably formed openings 12 therein, and with the rear edges of the channel member turned inwardly toward one another at 13 and 14 to define a narrow opening 15 therebetween. A pair of clips 16 in accordance with the invention are assembled to the support member 11, and a pair of articles, such as bags of chips or the like 17, are held to the display rack 10 with their upper edges gripped between the clips 16 and one surface or face of the support member 11.

Figure 2:
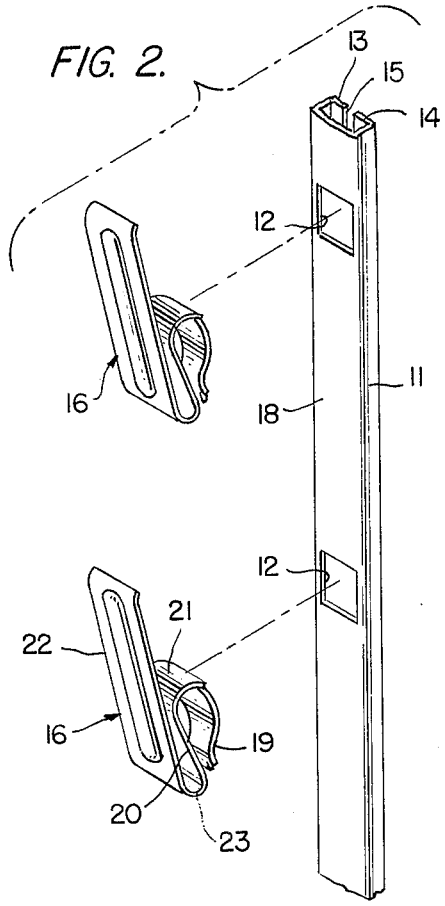
FIG. 2 is an exploded, fragmentary, perspective view of the clips and support member of FIG. 1.
Figure 3:
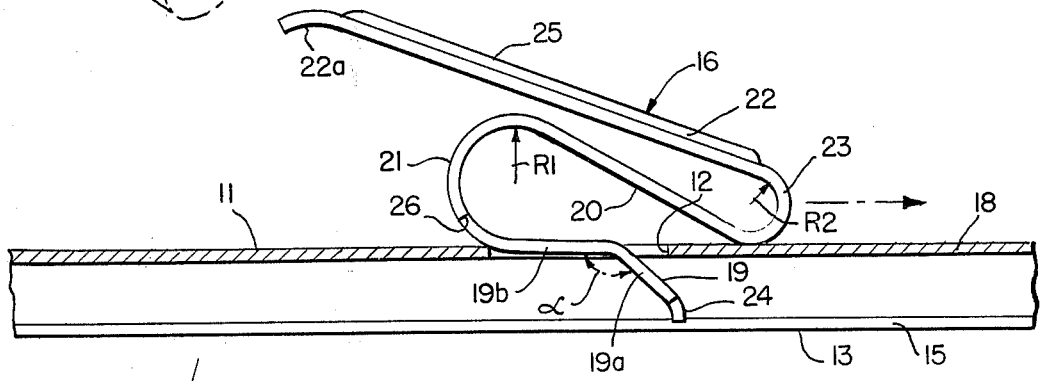
FIG. 3 is a greatly enlarged view in section of the channel of FIG. 1 with the clip of FIG. 1 being assembled thereto.
Figure 4:
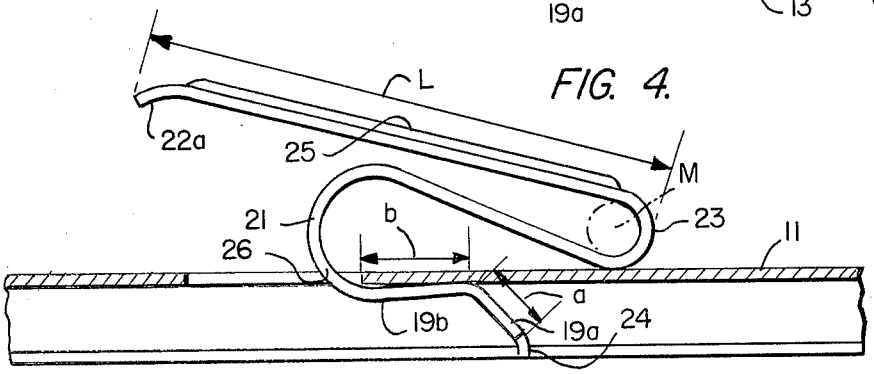
FIG. 4 is a view similar to FIG. 3 with the clip fully assembled to the channel member.

As seen in FIGS. 2, 3 and 4, the support member 11 has a front wall or face 18, through which the openings 12 are formed, as by punching or the like, and, as noted previously, the rear edges of the channel member are turned toward one another at 13 and 14 to define the space 15 therebetween.

The clips 16 are substantially S-shaped in configuration and have a first end portion 19 joined to an intermediate portion 20 by means of a first curved portion 21, and the intermediate portion 20 is joined to the other end portion 22 of the clip by means of a second curved portion 23, which as viewed in FIGS. 3 and 4, is adjacent the first end portion 19.

The end portion 19 comprises two angularly offset portions **19*a* and 19*b*, which define an obtuse angle $\alpha$ of approximately 135° therebetween, and a small tip 24 is on the extreme outer end of the end portion 19*a* for facilitating entry of the end portion 19 into the opening 12 during machine assembly of the clip. This tip or extreme end portion 24 is turned downwardly at about 30° from the axis of the outer end portion 19*a* and is approximately 0.05 inches long and 0.094 inches wide. The end portion 19*a*** has a length *a* of approximately 0.150 inches and the end portion **19*b*** has a length *b* of approximately 0.190 inches, and the end portion 19 gradually increases in width from a width W1 at the outer end of portion **19*a* of about 0.28 inches to a width W2 at the rear end of portion 19*b* of about 0.32 inches, and the remaining portions 20, 21, 22 and 23** of the clip have a constant width W3 of about three-eighths of an inch.

The first curved portion 21 has a radius of curvature R1 of approximately 0.125 inches and the second curved portion 23 has a radius of curvature R2 of approximately 0.0625 inches.

The other end portion 22 of the clip is substantially longer than end portion 19 and has a length L of approximately 1¼ inches, and as seen in FIGS. 3 and 4, the outer end 22a thereof is curved downwardly slightly and the portion 22 comprises a lever or handle which may be pressed upon to pivot the clip about first curved portion 21 to raise or release the second curved portion 23 from the support member 18 to release an article gripped therebetween. A reinforcing channel or rib 25 is also formed on the end portion 22 to rigidify it. The spring steel clip has a thickness of about 0.020 inches and thus exerts substantial force on an article gripped thereby, and considerable force is required to remove the clip from the support member.

A shoulder 26 is formed between the curved portion 21 and the end portion 19, and when the clip is fully inserted into the opening 12, the shoulders 26 at opposite sides of the clip engage the support member on opposite sides of the opening 12 to limit insertion of the end portion 19 into the opening to a predetermined distance for obtaining the most effective gripping action of curved portion 23 against the face 18 of support member 11.

As indicated in phantom lines in FIG. 4 at M, a suitable machine may be utilized having a bar inserted within the curved portion 23 for assembling the clips to the support member 11.

It is apparent when viewing FIGS. 3 and 4 that when the clip 16 is assembled to the support member 11, the end portion 19 and intermediate portion 20 are urged relatively apart by engagement of the end portion 19 against the underside of support 11 and engagement of the curved portion 23 against the face of support member 11, thus effecting a secure gripping and clamping action between the curved portion 23 and support member 11 and also insuring that the clip is not easily accidentally removed from the support member. In fact, the clip is securely latched to the support member and considerable force is required to remove it therefrom, due to the unique configuration and construction of the end portion 19 and other portions of the clip.

Further, the reduced size tip portion 24 extends into the space 15 between opposite edges 13 and 14 of the support member when the clip is fully assembled to the support member, and thus tends to prevent sideward rocking movement of the clip relative to the support member.

In FIG. 5, a first modification of the support member 11a has the opposite edges 13*a* and 14*a* thereof directed laterally outwardly away from one another rather than toward one another as in FIG. 2. In all other respects, this form of the invention is identical to that previously described.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A display rack clip for supporting articles, such as bags of chips and the like, for display and sale to the public, comprising a substantially S-shaped spring clip having first and second end portions and an intermediate portion and first and second curved portions joining the intermediate portion with a respective end portion, one end portion adapted to be inserted through a clip-receiving opening in a support member for yielding but firm engagement of an adjacent one of said curved portions against said support member to releasably grip an article therebetween, and the other of said end portions comprising a lever for disengaging said one curved portion from the support member to release the article, said one end portion including two angularly offset portions and an axially extending tip portion which engages one face of the support member to urge said second end portion and said intermediate portion relatively apart for effecting a secure clamping action between said first curved portion and the support member.

2. A clip as in claim 1, wherein said clip comprises spring steel and said one end portion includes an angularly inclined portion to facilitate entry thereof into said opening.

3. A clip as in claim 2, wherein said one end portion tapers inwardly at its opposite edges to the free end thereof.

4. A clip as in claim 1, wherein said other end portion is greater in length than said one end portion and is engageable with the other of said curved portions to act as a lever in disengaging the said one curved portion from the support member.

5. A clip as in claim 4, wherein a longitudinally extending reinforcing rib is on said other end portion.

6. A clip as in claim 5, wherein said clip comprises spring steel and said one end portion includes an angularly inclined portion to facilitate entry thereof into said opening and said one end portion tapers inwardly at its opposite edges to the free end thereof.

7. A clip as in claim 1, wherein said one curved portion defines a machine-engageable portion for machine assembly of the clip to the support member.

8. A clip as in claim 1, wherein said support member comprises an elongate channel member having a front wall and opposite side walls with the edges of the side walls directed laterally outwardly away from one another, said clip-receiving opening being in the front wall.

9. In combination, a support member and display rack clip for supporting articles, such as bags of chips and the like, for display and sale to the public, said support member comprising an elongate channel member having a front wall with at least one opening therein, and said clip comprising a substantially S-shaped spring clip having first and second end portions and an intermediate portion and first and second curved portions joining the intermediate portion with a respective end portion, one of said end portions inserted through the opening in said support member with an adjacent one of said curved portions yieldably and firmly engaged against said front wall of said support member to releasably grip an article therebetween, and the other of said end portions comprising a lever for disengaging said one curved portion from the support member to release the article, said one end portion including two angularly offset portions and an axially extending tip portion which engages one face of the support member to urge said second end portion and said intermediate portion relatively apart for effecting a secure clamping action between said first curved portion and the support member.

10. The combination as defined in claim 9, wherein said support member has opposite side walls along opposite edges of the front wall, and the edges of the side walls are directed toward one another in parallel relationship to define a narrow elongate slot or opening therebetween.

11. A clip as in claim 10 wherein said tip portion projects from the free end of said one end portion, and extends into the slot to prevent sideward rocking movement of the clip.

12. The clip defined in claim 3 further including a shoulder located on each of said opposite edges to engage the support member on opposite sides of said clip-receiving opening to limit insertion of said one end portion into said opening to a predetermined distance.

13. A clip as defined in claim 1 wherein said support member has a front wall, and opposite side walls along opposite edges of said front wall and the edges of said side walls are directed toward one another in parallel relationship to define a narrow elongate slot or opening therebetween.

14. A clip as defined in claim 13 wherein said tip portion projects from the free end of said one end portion, and extends into the slot to prevent sideward rocking movement of the clip.

* * * * *